US011408709B2

(12) United States Patent
DeSantis et al.

(10) Patent No.: US 11,408,709 B2
(45) Date of Patent: Aug. 9, 2022

(54) HOLSTER FOR A PISTOL

(71) Applicant: Gunhide Properties, LLC, Amityville, NY (US)

(72) Inventors: Gene DeSantis, Brookville, NY (US); Omar Montano, West Babylon, NY (US)

(73) Assignee: GUNHIDE PROPERTIES, LLC, Amityville, NY (US)

( * ) Notice: Subject to any disclaimer, the term of this patent is extended or adjusted under 35 U.S.C. 154(b) by 0 days.

(21) Appl. No.: 16/881,660

(22) Filed: May 22, 2020

(65) Prior Publication Data

US 2021/0364250 A1 Nov. 25, 2021

(51) Int. Cl.
*F41C 33/02* (2006.01)

(52) U.S. Cl.
CPC ..... *F41C 33/0254* (2013.01); *F41C 33/0209* (2013.01)

(58) Field of Classification Search
CPC ..... F41C 33/0254; F41C 33/0209
See application file for complete search history.

(56) References Cited

U.S. PATENT DOCUMENTS 3,669,325 A * 6/1972 Furman ..... F41C 33/0272 224/243
3,942,692 A * 3/1976 Chica ..... F41C 33/0227 224/243
7,644,845 B2 * 1/2010 Lowe ..... F41C 33/0245 224/243
9,759,515 B2 * 9/2017 Yeates ..... F41C 33/0272
10,900,744 B1 * 1/2021 Houck ..... F41C 33/0209
2007/0181619 A1 * 8/2007 Seyfert ..... F41C 33/04 224/196
2008/0121670 A1 * 5/2008 Buress ..... F41C 33/0263 224/243

OTHER PUBLICATIONS

Sniper Country, "The 4 Best Glock 22/ 17 Holsters With Light," https://www.snipercountry.com/glock-22-holster-with-light/, (c) 2019, Accessed Nov. 5, 2019.

* cited by examiner

*Primary Examiner* — Derek J Battisti
(74) *Attorney, Agent, or Firm* — Bennet K. Langlotz; Langlotz Patent & Trademark Works, LLC

(57) ABSTRACT

Holsters for a pistol have a body defining a receptacle configured to removably receive in a holstered condition a pistol with an illuminator device, the body when oriented for use having an open upper end from which the grip extends when in the holstered condition, the receptacle having a forward surface associated with the slide, the receptacle having a trigger guard space defined by a trigger guard support portion of the body, the receptacle having an illuminator space below the trigger guard and aft of a lower portion of the forward surface and configured to receive the illuminator device, and the forward surface of the receptacle having a relief space configured to receive the top surface of the slide adjacent to the muzzle end when the pistol is rotated while moved between an unholstered condition and the holstered condition such that the illuminator device clears the trigger guard support portion.

8 Claims, 9 Drawing Sheets

HOLSTER FOR A PISTOL

FIELD OF THE INVENTION

The present invention relates to firearms, and more particularly to a holster for a pistol that enables a pistol with an attached flashlight to be holstered and drawn easily.

BACKGROUND OF THE INVENTION

In many pistol applications, including law enforcement and self-defense, it is desirable to have a flashlight attached to the pistol for use in dark interiors and at night. Most pistol holsters are designed to hold a pistol without any attachments. While specialized holsters exist that accommodate both a pistol and an attached accessory such as a flashlight, they lack interior features that ensure the pistol can be holstered and drawn easily without the flashlight accessory snagging.

Therefore, a need exists for a new and improved holster for a pistol that enables a pistol with an attached flashlight to be holstered and drawn easily. In this regard, the various embodiments of the present invention substantially fulfill at least some of these needs. In this respect, the holster for a pistol according to the present invention substantially departs from the conventional concepts and designs of the prior art, and in doing so provides an apparatus primarily developed for the purpose of providing a holster that enables a pistol with an attached flashlight to be holstered and drawn easily.

SUMMARY OF THE INVENTION

The present invention provides an improved holster for a pistol, and overcomes the above-mentioned disadvantages and drawbacks of the prior art. As such, the general purpose of the present invention, which will be described subsequently in greater detail, is to provide an improved holster for a pistol that has all the advantages of the prior art mentioned above.

To attain this, the preferred embodiment of the present invention essentially comprises a body defining a receptacle configured to removably receive in a holstered condition a pistol having a grip, a slide, a muzzle end and a trigger guard, and an illuminator device connected below the muzzle end of the pistol and forward of the trigger guard, the body when oriented for use having an open upper end from which the grip extends when in the holstered condition, the receptacle having a forward surface associated with a top surface of the slide, the receptacle having a trigger guard space configured to receive the trigger guard and defined by a trigger guard support portion of the body, the receptacle having an illuminator space below the trigger guard and aft of a lower portion of the forward surface and configured to receive the illuminator device, and the forward surface of the receptacle having a relief space configured to receive the top surface of the slide adjacent to the muzzle end when the pistol is rotated while moved between an unholstered condition and the holstered condition such that the illuminator device clears the trigger guard support portion. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
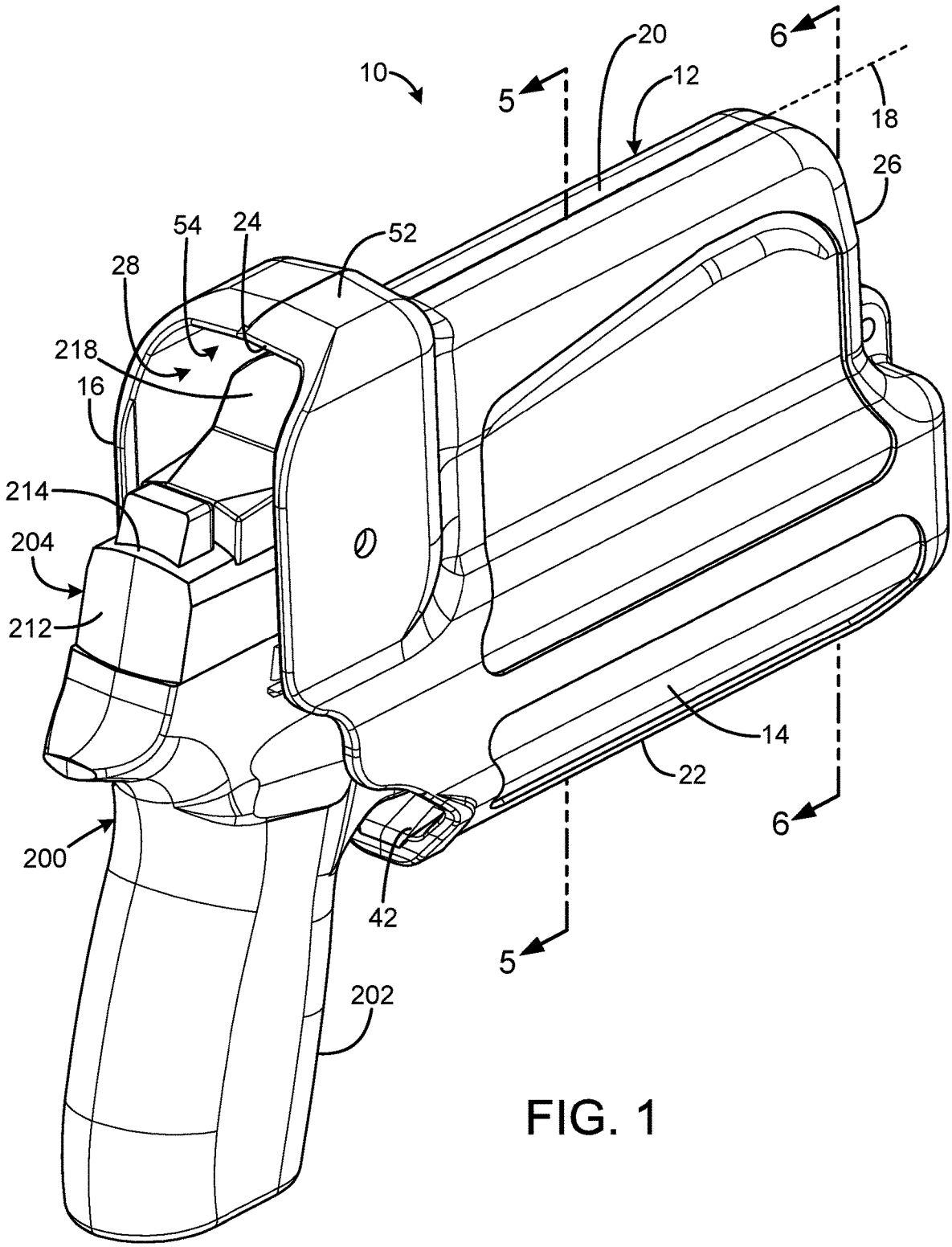
FIG. 1 is a top isometric view of the current embodiment of a holster for a pistol constructed in accordance with the principles of the present invention in use with a pistol in the holstered condition.

An embodiment of the holster for a pistol of the present invention is shown and generally designated by the reference numeral 10.

Figure 2:
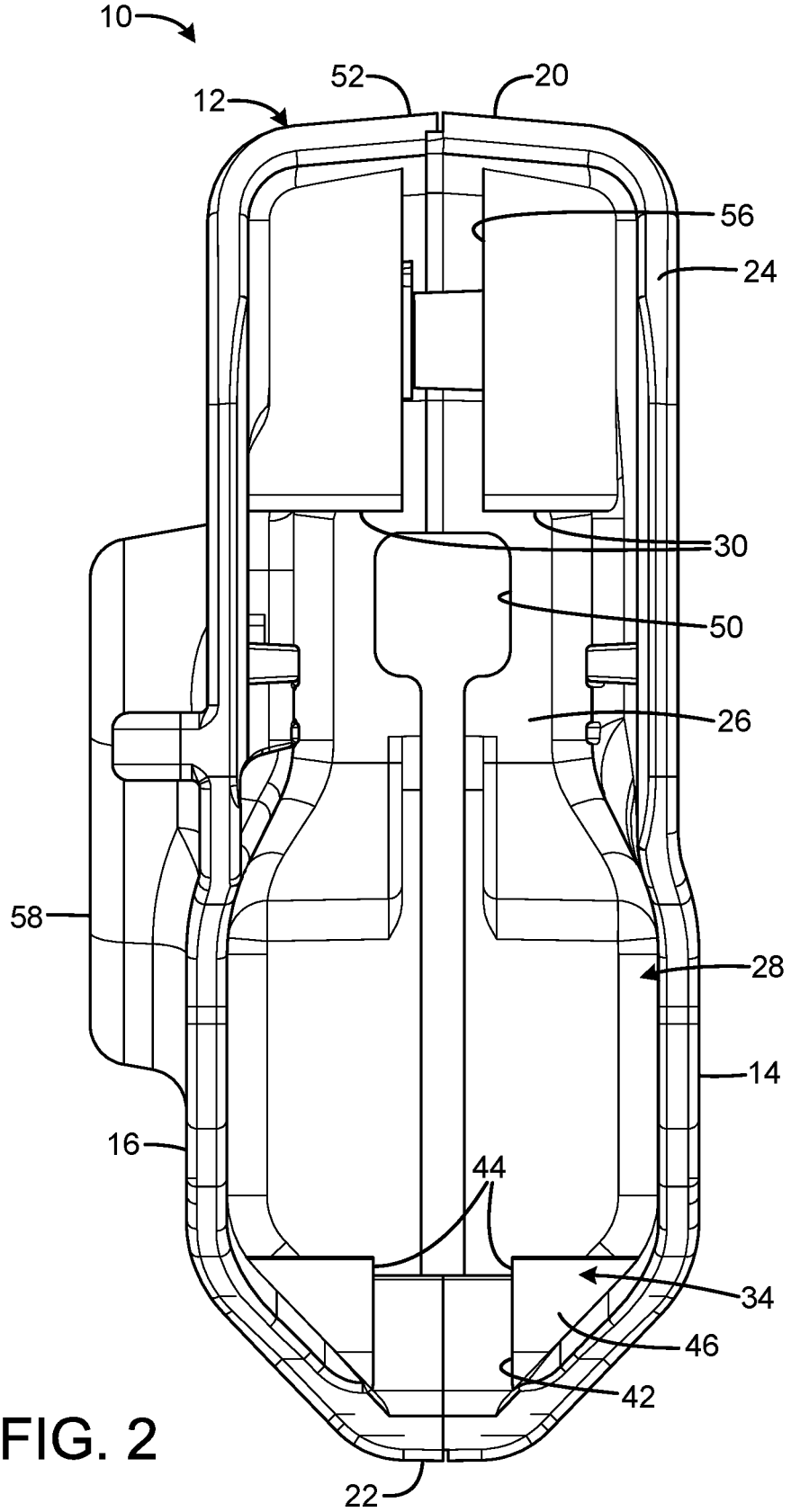
FIG. 2 is a top view of the holster for a pistol of FIG. 1 without the pistol.
Figure 3:
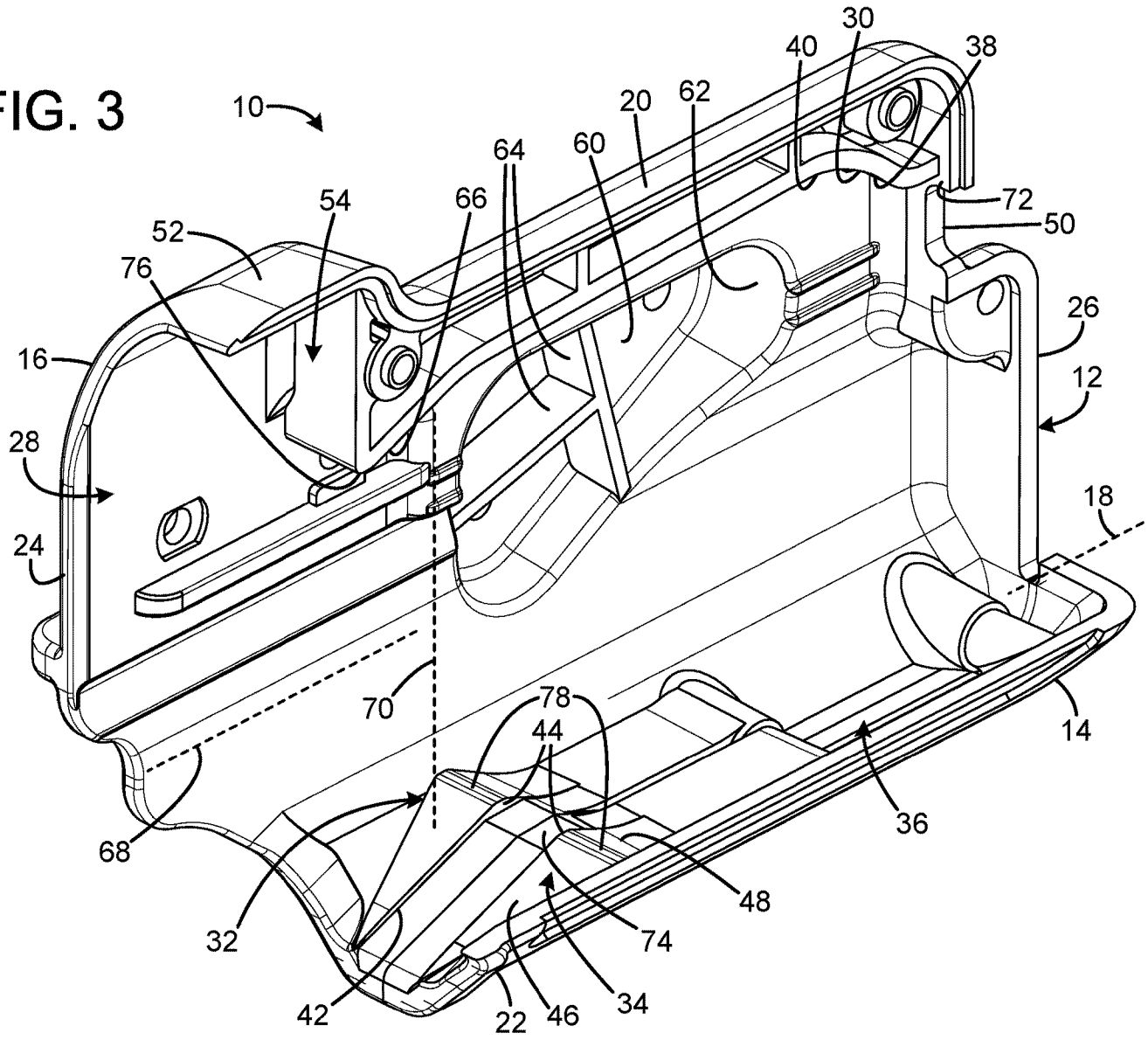
FIG. 3 is a top isometric cutaway view of the holster for a pistol of FIG. 1 without the pistol.
Figure 4:
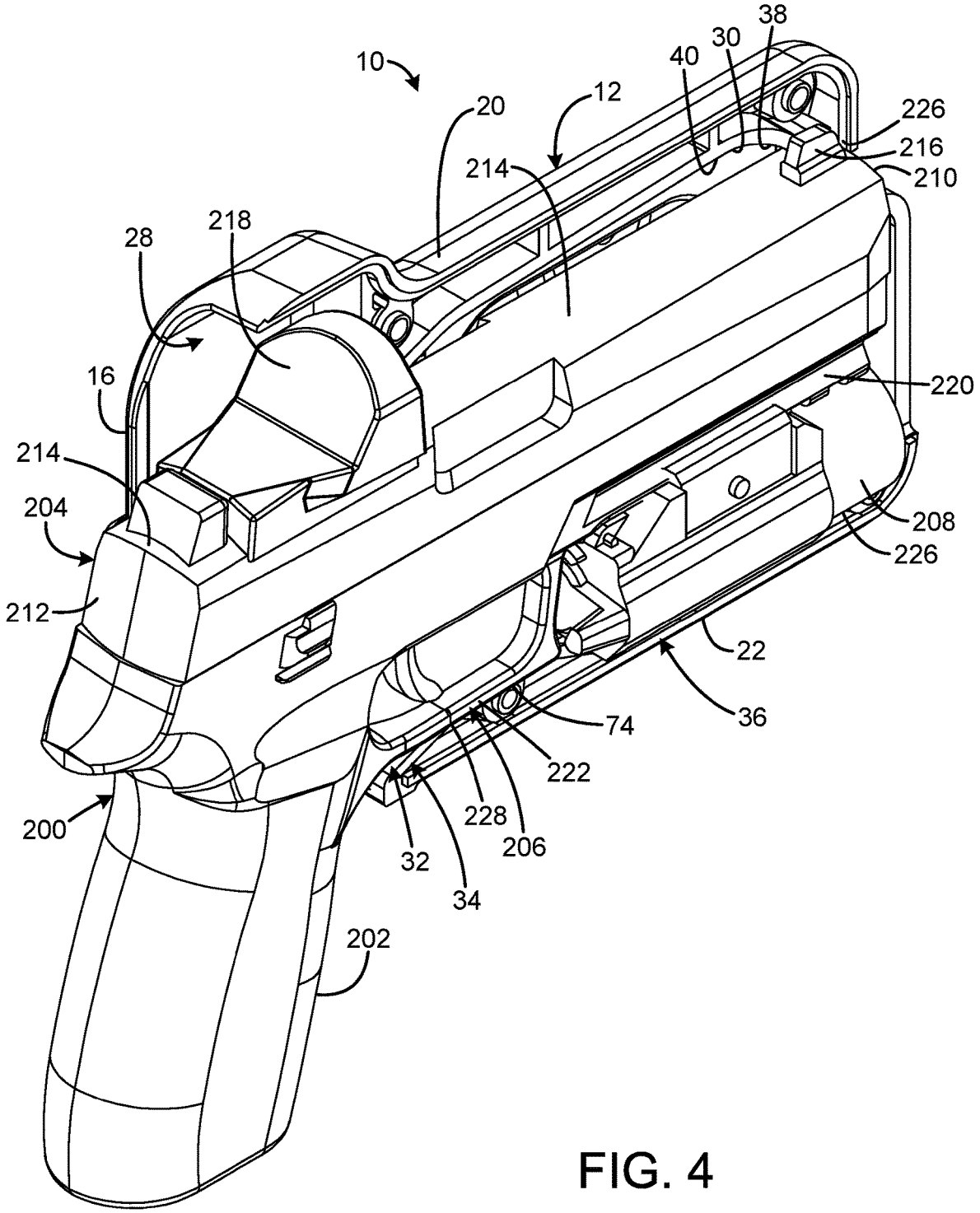
FIG. 4 is a top isometric cutaway view of the holster for a pistol of FIG. 1 with the pistol in the holstered condition.
Figure 5:
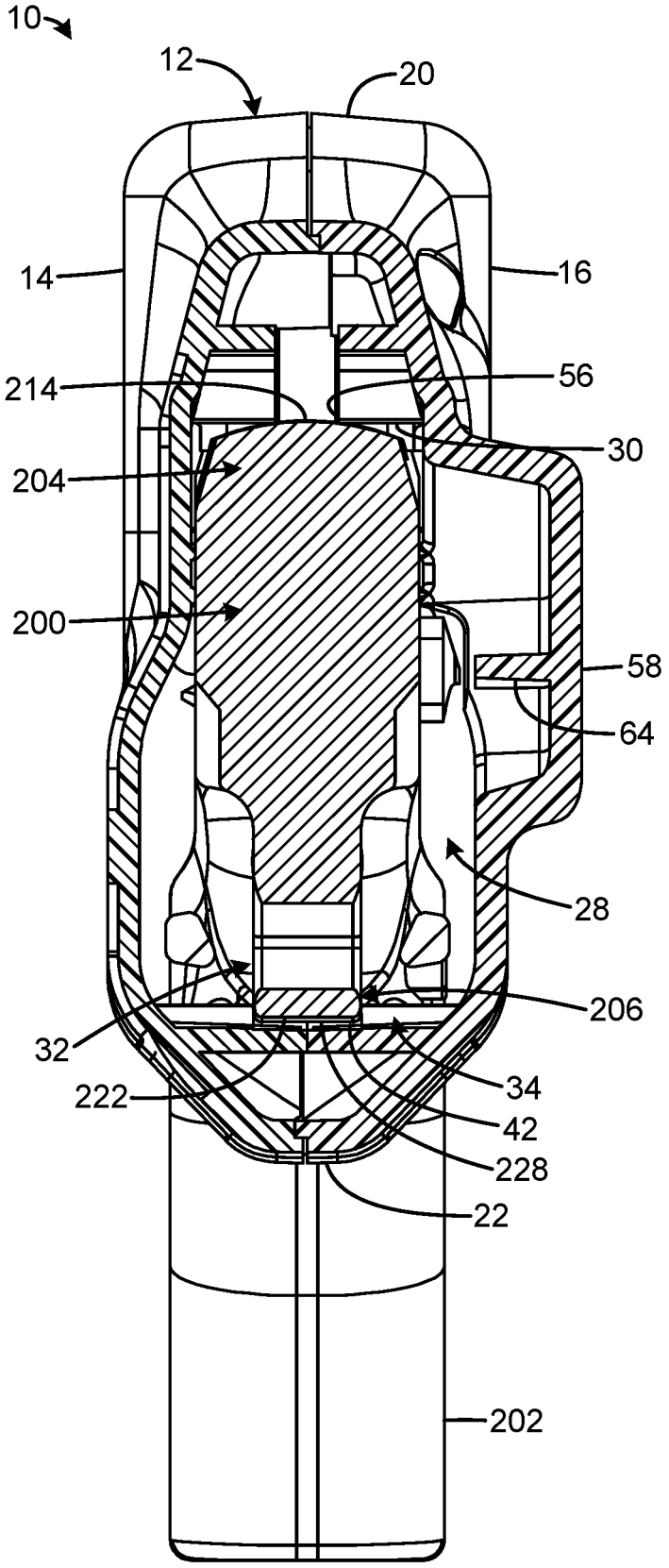
FIG. 5 is a bottom sectional view of the holster for a pistol taken along line 5-5 of FIG. 1.
Figure 6:
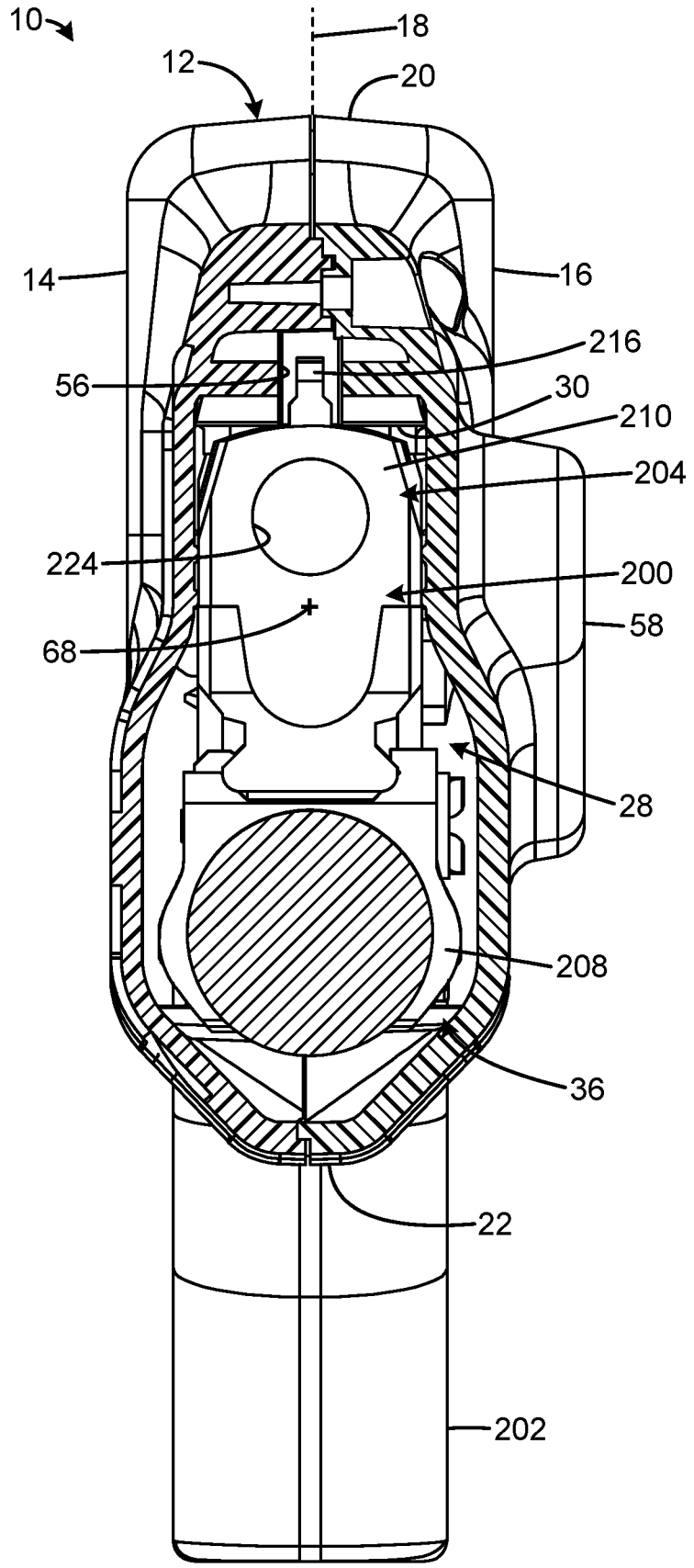
FIG. 6 is a bottom sectional view of the holster for a pistol taken along line 6-6 of FIG. 1.
Figure 7:
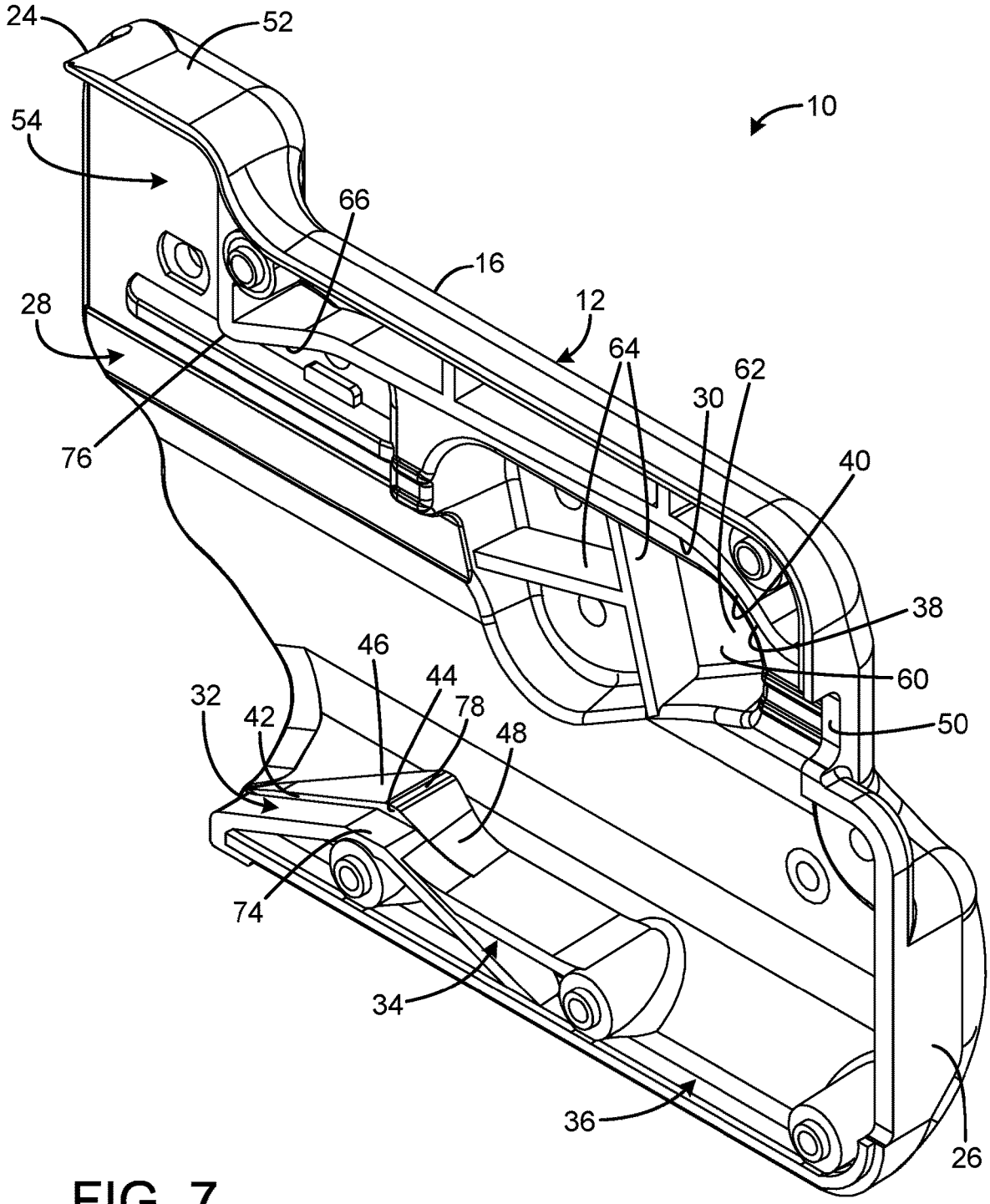
FIG. 7 is a bottom isometric cutaway view of the holster for a pistol of FIG. 1 without the pistol.

FIGS. 1-7 illustrate the improved holster for a pistol 10 of the present invention. More particularly, FIGS. 1 and 4-6 show the holster with a pistol 200 in the holstered condition, and FIGS. 2, 3, and 7 show the holster without the pistol. The holster has a body 12 having a right half 14 and a left half 16. The right half and left half are shells formed of plastic in the current embodiment. Each is an integral unitary element. The forward portion of the pistol and any attached accessories are captured between the right and left halves. The left and right halves are held together by retaining screws and/or retaining pins (not shown) such that the right and left halves separably contact each other at a medial plane 18. Although many of the features of the holster that will be described result from the mating of the right half with the left half, the features of the holster will be described as if the holster were of unitary construction.

The body 12 of the holster 10 has a front 20, rear 22, open upper end 24, and bottom 26. The body defines a receptacle 28 configured to removably received in a holstered condition the pistol 200. The pistol has a grip 202, slide 204, trigger guard 206, and illuminator device 208. The slide has a muzzle end 210, a rear end 212, and a top surface 214. A front sight blade 216 extends upwardly from the top surface at the muzzle end of the slide. A rear sight 218 extends upwardly from the top surface adjacent to the rear end of the slide. The illuminator device is releasably connected to a Picatinny rail 220 located below the muzzle end of the slide and forward of the trigger guard.

When the body 12 is oriented for use, the grip 202 extends from the open upper end 24 when the pistol 200 is in the holstered condition. The receptacle 28 has a forward surface 30 associated with the top surface 214 of the slide 204. In the current embodiment, the muzzle end of the slide contacts the forward surface when the pistol is in the holstered condition. The receptacle has a trigger guard space 32 configured to receive the trigger guard 206 and defined by a trigger guard support portion 34 of the body. The receptacle has an illuminator space 36 below the trigger guard and aft of a lower portion 38 of the forward surface 30 and configured to receive the illuminator device 208. The forward surface of the receptacle has a relief space 40 configured to receive the top surface of the slide adjacent to the muzzle end when the pistol is rotated while being moved between an unholstered condition and the holstered condition such that the illuminator device clears the trigger guard support portion. The pistol rotation process to holster and unholster the pistol will be described in more detail in the discussion of FIGS. 8-12.

In the current embodiment, the illuminator space 36 extends aft of the trigger guard space 32. The relief space 40 is concave rearward and extends from proximate the muzzle end 210 of the slide 204 of the pistol 200 in the holstered condition to a level registered with the trigger guard 206. The illuminator space 36 is spaced apart from the illuminator device 208 such that any of a plurality of different shaped and sized illuminator devices may be accommodated. The illuminator space is wider than the receptacle 28 forward of the illuminator space and associated with the muzzle end of the slide of the pistol.

The trigger guard support portion 34 of the body 12 defines a trigger guard channel 42 configured to closely receive a portion of the trigger guard 206. In the current embodiment, the trigger guard channel includes opposed sidewalls 44 spaced apart to receive a lower portion 222 of the trigger guard. The trigger guard support portion also includes an upper ramp 46 and a lower ramp 48 that guide the illuminator device 208 into and out of the receptacle 28 as the pistol 200 is holstered and unholstered.

The bottom 26 of the body 12 defines a bottom opening 50, at least a portion of which exposes at least a portion of the muzzle 224 of the pistol 200. The portion of the body adjacent to the open upper end 24 forms an enlarged rear sight hood 52 that defines a rear sight space 54. The rear sight 218 of the pistol is received within the rear sight space and protected by the rear sight hood when the pistol is in the holstered condition. The forward surface 30 is bisected by a front sight blade channel 56. The front sight blade channel prevents the forward surface from obstructing the front sight blade 216 as the pistol is holstered and unholstered. A mounting surface 58 protrudes outwardly from the left half 16. The underside of the mounting surface 60 defines a recess 62 and is supported by support ribs 64 located within the recess. The mounting surface enables the holstered 10 to be releasably attached to a bracket on a wearer's belt (not shown).

The portion of the forward surface 30 closest to the open upper end 24 of the body 12 has an upper ramp 66. The upper ramp 66 is sloped at the same angle relative to the vertical axis 68 of the body as the upper ramp 46 of the trigger guard support portion 54. The spacing 70 between the two upper ramps is determined by the distance between the top surface 214 of the slide 204 and the lower surface 226 of the illuminator device 208. The spacing must be sufficiently wide so that the muzzle end 210 of the pistol 200 with the attached illuminator device can slide between the two upper ramps as the pistol is holstered and unholstered.

It should be appreciated that when the pistol 200 is in the holstered condition, the pistol only contacts the holster 10 at three locations: the muzzle contact point 72, the trigger guard contact point 74, and the slide contact point 76. The trigger guard contact point is parallel to the bottom 228 of the trigger guard. The intersection of the upper ramp 46 and lower ramp 48 of the trigger guard support portion 34 on the opposed sidewalls 44 has a radiused portion 78 to guide the illuminator device 208 and the pistol up and over the trigger guard support portion as the pistol is holstered and unholstered. The trigger guard channel 42 prevents lateral movement of the pistol within the holster.

Figure 8:
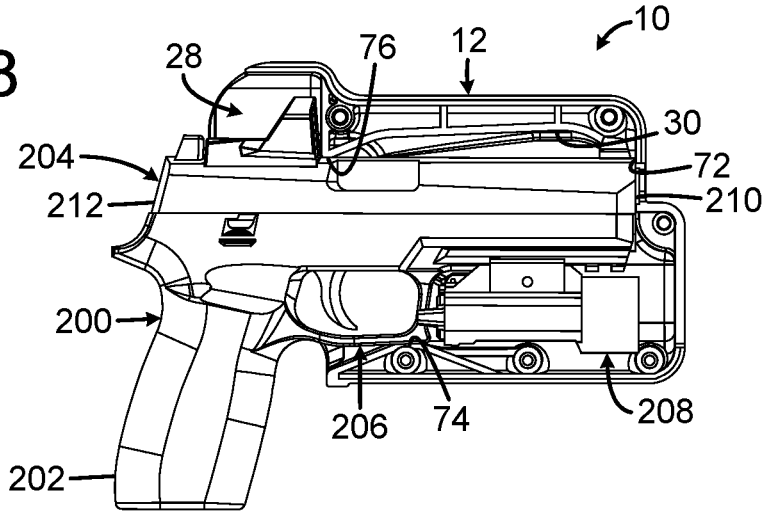
FIG. 8 is a side sectional view of the holster for a pistol of FIG. 1 with the pistol in the holstered condition.
Figure 9:
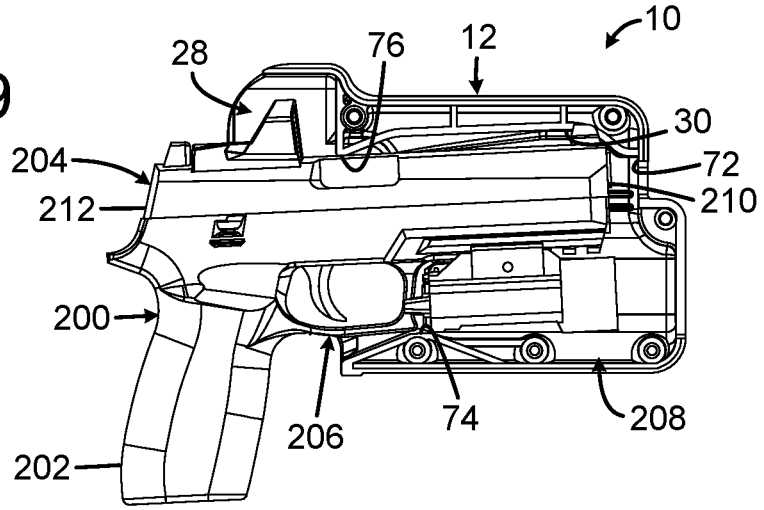
FIG. 9 is a side sectional view of the holster for a pistol of FIG. 1 with the pistol in the initial stage of being drawn from the holster.
Figure 10:
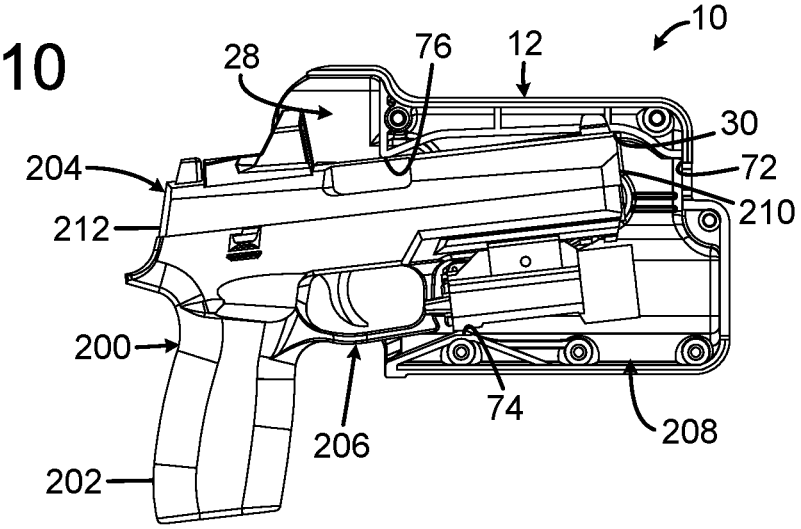
FIG. 10 is a side sectional view of the holster for a pistol of FIG. 1 with the pistol being further drawn from the holster relative to FIG. 9.
Figure 11:
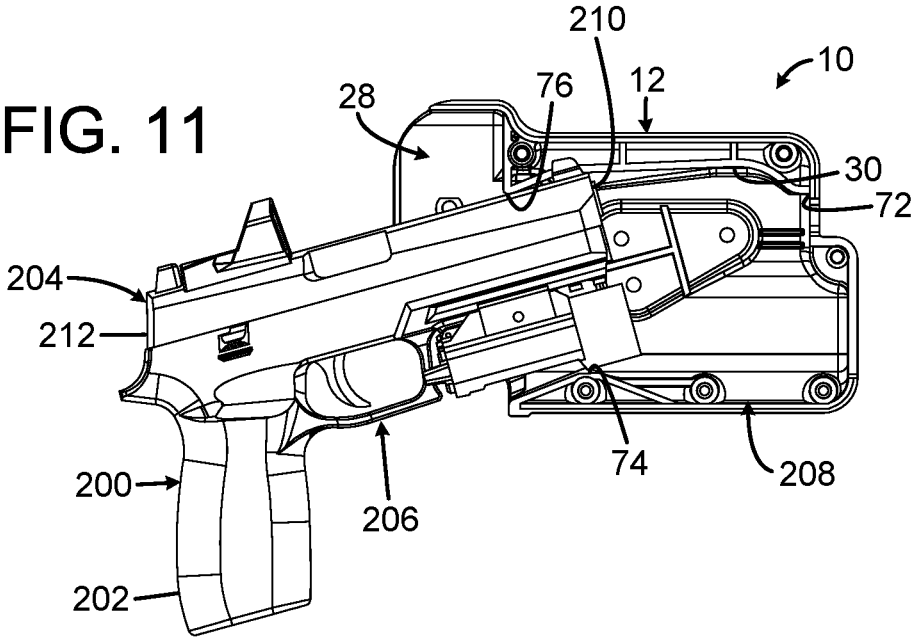
FIG. 11 is a side sectional view of the holster for a pistol of FIG. 1 with the pistol being further drawn from the holster relative to FIG. 10.
Figure 12:
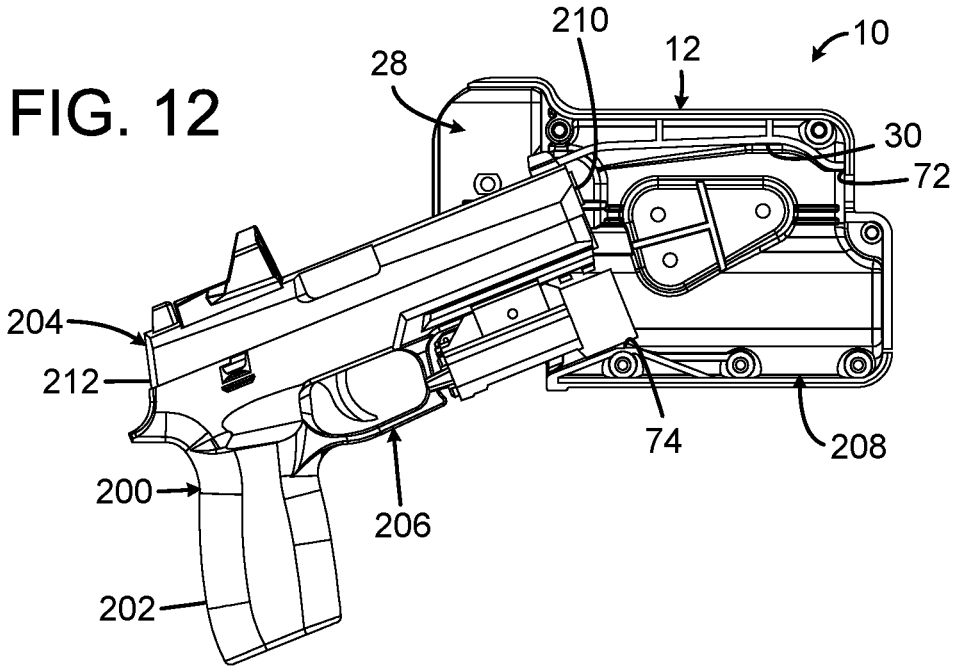
FIG. 12 is a side sectional view of the holster for a pistol of FIG. 1 with the pistol being further drawn from the holster relative to FIG. 11.

FIGS. 8-12 illustrate the improved holster for a pistol 10 of the present invention. More particularly, the pistol rotation process to unholster the pistol 200 is shown. FIG. 8 shows the pistol in the holstered condition. FIG. 9 shows the pistol at the point of initiation of the unholster in process with the pistol rotating counterclockwise as the trigger guard 206 is disengaged from the trigger guard contact point 74. The counterclockwise rotation of the pistol is guided by contact between the forward surface 30 of the holster and the top surface 214 of the slide 204. FIG. 10 shows the pistol further withdrawn from the holster relative to FIG. 9 with the pistol rotating further counterclockwise as the radiused portion 78 of the trigger guard support portion 34 guides the illuminator device 208 up and over the trigger guard support portion. The counterclockwise rotation of the pistol is also guided by contact between the forward surface of the holster and the top surface of the slide. FIG. 11 shows the pistol further withdrawn from the holster relative to FIG. 10 with the pistol rotating further counterclockwise as the illuminator device continues to ride up and over the trigger guard support portion. The counterclockwise rotation of the pistol is also guided by contact between the forward surface of the holster and the top surface of the slide. FIG. 12 shows the pistol further withdrawn from the holster relative to FIG. 11 with the pistol rotating further counterclockwise as the illuminator device continues to ride up and over the trigger guard support portion. The counterclockwise rotation of the pistol is also guided by contact between the forward surface of the holster and the top surface of the slide. In FIG. 12, the top surface 214 of the slide 204 is parallel to the upper ramp 66 on the forward surface 30, and the lower surface 226 of the illuminator device 208 is parallel to the upper ramp 46 of the trigger guard support portion. In the orientation shown in FIG. 12, the pistol can be fully unholstered by continuing to pull the pistol upward at an angle relative to the vertical axis 68 parallel to the angle of the two upper ramps. To holster the pistol, the process is reversed.

While a current embodiment of a holster for a pistol has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A holster for a pistol comprising: a body defining a receptacle configured to removably receive in a holstered condition a pistol having a grip, a slide, a muzzle end and a trigger guard, and an illuminator device connected below the muzzle end of the pistol and forward of the trigger guard; the body when oriented for use having an open upper end from which the grip extends when in the holstered condition; the receptacle having a forward surface associated with a top surface of the slide and defining a reference plane; the body defining an aft direction away from the forward surface; the receptacle having a trigger guard space configured to receive the trigger guard and defined by a trigger guard support portion of the body; the trigger guard support providing a ramp with a trigger guard contact point for the pistol; the receptacle having an illuminator space below the trigger guard and aft of a lower portion of the forward surface and configured to receive the illuminator device; the forward surface of the receptacle having a relief space configured to receive the top surface of the slide adjacent to the muzzle end when the pistol is rotated while moved between an unholstered condition and the holstered condition such that the illuminator device clears the trigger guard support portion; the forward surface having an upper portion providing a second ramp with slide contact point for the pistol; the slide contact point being at a level closer to the upper end of the body than the trigger guard contact point is to the upper end of the body; the distance between the trigger guard contact point and the slide contact point of support being greater than the lateral separation between the trigger guard contact point and the slide contact point in a direction perpendicular to the reference plane; the relief space being forward of the slide contact point; and the trigger guard support portion of the body being immovable to prevent extraction of the pistol except upon such rotation of the pistol, and remaining unmoved upon such rotation that bypasses the trigger guard support portion without requiring flexure of any portion of the body.

2. The holster of claim 1 wherein the illuminator space extends aft of the trigger guard space.

3. The holster of claim 1 wherein the relief space is concave rearward.

4. The holster of claim 1 wherein the relief space extends from proximate the muzzle end of the pistol in the holstered condition to a level registered with the trigger guard.

5. The holster of claim 1 wherein the illuminator space is spaced apart from the illuminator device such that any of a plurality of different shaped and sized illuminator devices may be accommodated.

6. The holster of claim 1 wherein the illuminator space is wider than the receptacle forward of the illuminator space and associated with the muzzle end of the pistol.

7. The holster of claim 1 wherein the trigger guard support portion defines a channel configured to closely receive a portion of the trigger guard.

8. The holster of claim 7 wherein the channel includes opposed side walls spaced apart to receive a lower portion of the trigger guard.

* * * * *